US006170399B1

(12) United States Patent
Nielson et al.

(10) Patent No.: US 6,170,399 B1
(45) **Date of Patent: *Jan. 9, 2001**

(54) FLARES HAVING IGNITERS FORMED FROM EXTRUDABLE IGNITER COMPOSITIONS

(75) Inventors: Daniel B. Nielson, Brigham City, UT (US); Gary K. Lund, Malad, ID (US); Reed J. Blau, Richmond, UT (US)

(73) Assignee: Cordant Technologies Inc., Salt Lake City, UT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/119,518

(22) Filed: Jul. 21, 1998

Related U.S. Application Data

(60) Provisional application No. 60/057,601, filed on Aug. 30, 1997.

(51) Int. Cl.[7] ..... F42B 4/26; C06C 5/04

(52) U.S. Cl. ..... 102/336; 102/275.4; 102/275.8; 149/45

(58) Field of Search ..... 102/275.4, 275.8, 102/336; 149/45

(56) References Cited

U.S. PATENT DOCUMENTS

| | | | | |
|---|---|---|---|---|
| 2,416,639 | | 2/1947 | Pearsall | 52/2 |
| 2,923,239 | * | 2/1960 | Andrew et al. | 102/275.4 |
| 3,062,147 | | 11/1962 | Davis et al. | 102/70 |
| 3,257,801 | | 6/1966 | Martinez et al. | 60/35.4 |
| 3,338,764 | | 8/1967 | Evans | 149/19 |
| 3,407,731 | | 10/1968 | Evans | 102/27 |
| 3,420,137 | | 1/1969 | Staba | 86/1 |
| 3,682,727 | | 8/1972 | Heinzlmann et al. | 149/19 |
| 3,682,729 | | 8/1972 | Gukelberger, Jr. et al. | 156/13 |
| 3,745,927 | | 7/1973 | Tanner et al. | 102/103 |
| 3,841,929 | | 10/1974 | Craig | 149/17 |
| 3,899,973 | | 8/1975 | Brocart | 102/27 R |
| 3,912,562 | | 10/1975 | Garner | 149/41 |
| 3,986,908 | | 10/1976 | Grebert et al. | 149/19.7 |
| 4,080,902 | | 3/1978 | Goddard et al. | 102/70 R |
| 4,140,561 | | 2/1979 | Keith et al. | 149/2 |
| 4,220,087 | | 9/1980 | Posson | 102/27 R |
| 4,232,606 | * | 11/1980 | Yunan | 102/275.8 |
| 4,238,253 | | 12/1980 | Garner . | |
| 4,482,405 | | 11/1984 | Wright | 149/19.3 |
| 4,493,261 | * | 1/1985 | Simon et al. | 102/275.8 X |
| 4,607,573 | * | 8/1986 | Thureson et al. | 102/275.8 |
| 4,718,345 | * | 1/1988 | Yunan et al. | 102/275.4 X |
| 4,798,142 | | 1/1989 | Canterberry et al. | 102/290 |
| 4,853,052 | | 8/1989 | Calsson et al. | 149/109.6 |
| 4,931,112 | | 6/1990 | Wardle et al. | 149/88 |
| 4,963,201 | | 10/1990 | Bjerke et al. | 149/2 |
| 5,016,914 | | 5/1991 | Faigle et al. | 280/741 |
| 5,024,160 | | 6/1991 | Canterberry et al. | 102/323 |
| 5,062,365 | | 11/1991 | Canterberry | 102/322 |

(List continued on next page.)

FOREIGN PATENT DOCUMENTS

| | | |
|---|---|---|
| 240427 | 4/1946 | (CH) . |
| 32 43 425 | 5/1984 | (DE) . |
| 94 16 123 | 1/1995 | (DE) . |
| 0 310 580 | 4/1989 | (EP) . |
| 2015074 | 4/1970 | (FR) . |
| 2 235 348 | 1/1975 | (FR) . |
| 2 441 598 | 6/1980 | (FR) . |
| 566786 | 1/1945 | (GB) . |
| 1 231 181 | 5/1971 | (GB) . |

*Primary Examiner*—Peter A. Nelson
(74) *Attorney, Agent, or Firm*—Pillsbury Madison & Sutro LLP

(57) ABSTRACT

The present invention relates to flares and other solid propellant devices, rockets or the like, equipped with an igniter or igniter system which is based in whole in part on an extruded igniter stick.

30 Claims, 2 Drawing Sheets

U.S. PATENT DOCUMENTS

| | | | | |
|---|---|---|---|---|
| 5,125,684 | | 6/1992 | Cartwright | 280/736 |
| 5,216,199 | | 6/1993 | Bjerke et al. | 102/471 |
| 5,237,928 | | 8/1993 | Redecker | 102/431 |
| 5,273,309 | | 12/1993 | Lau et al. | 280/730 A |
| 5,317,974 | * | 6/1994 | Stewart et al. | 102/275.8 |
| 5,472,535 | | 12/1995 | Mendenhall et al. | 149/36 |
| 5,514,230 | | 5/1996 | Khandhadia | 149/36 |
| 5,516,377 | | 5/1996 | Highsmith et al. | 149/18 |
| 5,536,339 | | 7/1996 | Verneker | 149/19.5 |
| 5,540,154 | | 7/1996 | Wilcox et al. | 102/275.1 |
| 5,542,704 | | 8/1996 | Hamilton et al. | 280/741 |
| 5,597,973 | * | 1/1997 | Gladden et al. | 102/275.11 X |
| 5,610,364 | | 3/1997 | Endicott, Jr. et al. | 102/334 |
| 5,626,360 | | 5/1997 | Lauritzen et al. | 280/41 |
| 5,668,345 | | 9/1997 | Schroeder et al. | 102/289 |
| 5,670,098 | | 9/1997 | Dillehay et al. | 261/3.3 |
| 5,670,735 | | 9/1997 | Ortmann et al. | 102/202 |
| 5,735,118 | | 4/1998 | Hinshaw et al. | 149/45 X |
| 5,763,818 | | 6/1998 | Guymon et al. | 102/336 |
| 5,837,924 | * | 11/1998 | Austin | 102/275.4 X |

* cited by examiner

FLARES HAVING IGNITERS FORMED FROM EXTRUDABLE IGNITER COMPOSITIONS

RELATED APPLICATIONS

This is a complete application of provisional application No. 60/057,601 filed Aug. 30, 1997, the complete disclosure of which is incorporated herein by reference.

BACKGROUND OF THE INVENTION

1. Field of the Invention

The present invention relates to extrudable igniter compositions, and extruded ignition sticks therefrom, in combination with flares or other solid propellant devices, such as rockets or the like.

2. Background Information

Igniter compositions ought to satisfy a number of design criteria. The igniter composition, when formed, should be sufficiently robust to remain in operable form prior to deployment of the device to be ignited, such as a flare or other device.

One of the commonly proposed igniter systems uses solid particles consisting of $B/KNO_3$ which, when ignited, initiate combustion of the specified gas generant composition.

Other recent efforts in the civilian market have focused on developing alternative cost-effective igniter compositions or igniter compositions which are more easily manufactured. These efforts have included proposals to use a hot-melt thermoplastic resin matrix together with a particular igniter composition, such as $KNO_3$. This effort sought to marry a commercially available hot melt adhesive, such as one designed for so-called "glue-guns", with a common alkali metal oxidizer. This effort to improve performance was less than satisfactory. Extrudability and igniter performance proved difficult to control, and the repeatable ballistic performance desired has not yet been demonstrated.

Accordingly, despite these and still other efforts, relevant objectives remain unattained. A simpler, more cost-effective igniter composition for flares and decoys or other devices remains desired. In particular, efforts are still on-going towards providing an igniter composition which avoids the need for hot melting so-called adhesives, and thus the consequent risks associated with processing a pyrotechnic material at an elevated temperature, but which is facile to manufacture and would be sufficiently robust.

It would, therefore, be a significant advance to provide igniter compositions capable of being used as an igniter which satisfactorily address these concerns in the industry.

SUMMARY AND OBJECTS OF THE PRESENT INVENTION

The present invention offers flares, solid propellant rockets, decoy devices and the like incorporating one or more of the herein disclosed igniter sticks.

The extrudable igniter is readily manufactured at low cost to obtain a physically robust product. The igniter can be manufactured without the use of a thermoplastic melt or hot-melt mixing equipment, and thus avoids the potential hazards associated with processing at such elevated temperatures. The extrudable igniter composition from which the igniter stick can be formed is suitably processed at ambient temperatures into robust products which have sufficiently relatively selectable ignition characteristics. The igniter stick can have other configurations, provided the configuration is consistent with the objectives herein disclosed. The extrudable igniter composition can be used to form a solid or hollow igniter "stick" capable of igniting a flare or propellant composition in a flare or other pyrotechnic device.

DETAILED DESCRIPTION OF THE INVENTION

Figure 1:
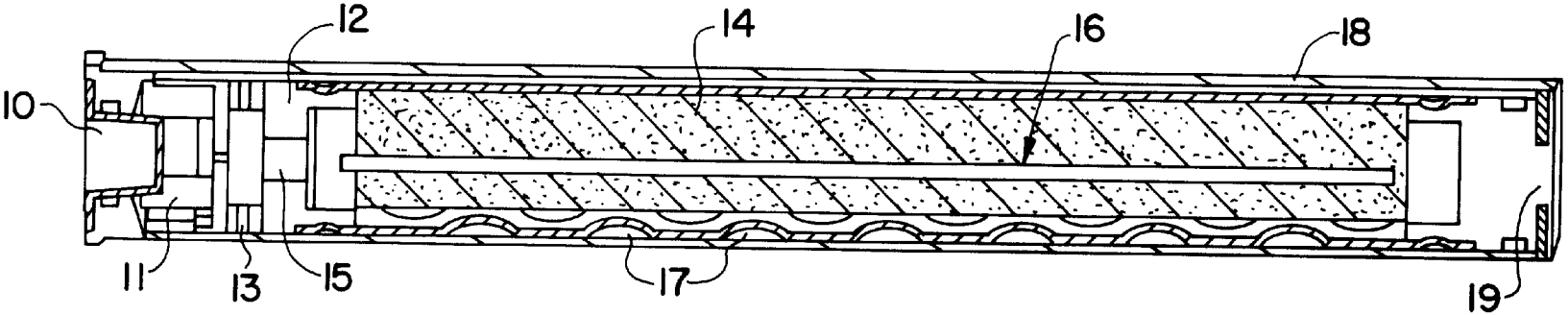
FIG. 1 illustrates an exemplary flare device (a XM212 type flare) in longitudinal cross-section which includes an igniter stick formed from the extrudable igniter composition.
Figure 2:
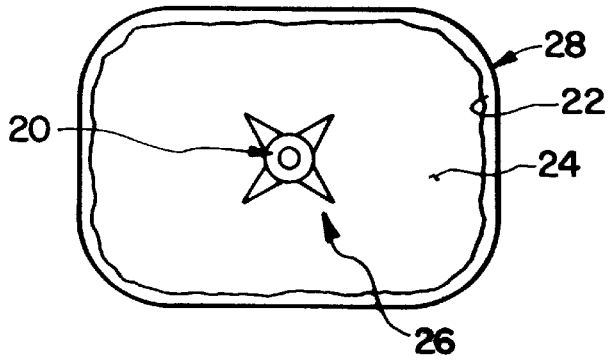
FIGS. 2, 3, 4 and 5 illustrate end views of igniter sticks fabricated from the disclosed extrudable igniter composition in combination with propellant loaded into a case.

The extruded igniter sticks can be characterized as having a configuration designed for rapid deflagration at a high temperature upon ignition. Upon ignition an igniter stick is capable of igniting another pyrotechnic composition. In flares, such as the XM212 flare, the igniter sticks are sized to be capable of complete end to end ignition, e.g., complete flame transition, in a short time, such as less than 10 miliseconds.

The igniter compositions which are capable of being extruded are characterized as being obtainable from a combination of a binder, water-soluble or dispersable oxidizing agent, water-soluble or dispersable fuel, and a selected amount of water. By preference, the extrudable compositions are essentially compositionally homogeneous.

The binder is, by present preference, a water-soluble binder, although water-swellable binder materials are not excluded provided that the remaining solid constituents of the igniter are at least substantially sufficiently homogeneously distributable therein. Typical binders used in the present igniter composition include, by way of example, water-soluble binders such as poly-N-vinyl pyrolidone, polyvinyl alcohols and coplymers thereof, polyacrylamide, sodium polyacrylates, copolymers based on acrylamide or sodium acrylate, gums, and gelatin. These water soluble binders include naturally occurring gums, such as guar gum, acacia gum, modified celluloses and starches. A detailed discussion of "gums" is provided by C. L. Mantell, *The Water-Soluble Gums,* Reinhold Publishing Corp., 1947, which is incorporated herein by reference. It is presently considered that the water-soluble binders improve mechanical properties or provide enhanced crush strength. Although water immiscible binders can be used in the present invention, it is currently preferred to use water soluble binders in combination with fuels and/or oxidizers suitable for use in formulating an igniter. The suitable fuels and oxidizers can be water soluble or water insoluble. Suitable fuels and oxidizers can be inorganic or organic.

In the formulation from which the extrudate igniter stick is formed, the binder concentration is such that a sufficiently mechanically robust extrudate is obtained. The extrudate, such as an igniter stick, should be capable of retaining its shape, e.g. maintaining its integrity, prior to ignition. By preference, the extruded igniter stick is capable of being received (inserted) in a pyrotechnic composition, e.g. a suitably configured bore (e.g. central bore) in a propellant composition, and of shattering or fracturing when ignited. In general, the binder can be in a range of, for example, of about 2% by weight to about 10% by weight, and more particularly about 3% by weight to about 7% by weight, relative to the dry ingredients in the formulation. The binder can be comprised of more than one binder material.

The igniter composition includes at least one oxidizer, which is preferably water soluble or at least water dispersable. The oxidizer can therefore be organic or inorganic, although inorganic oxidizers are presently preferred. Organic oxidizers which are dispersable in a binder so that a sufficiently homogeneous igniter composition is obtainable include amine nitrate salts, nitro compounds, nitramine, nitrate esters, and amine perchlorates, of which methyl ammonium nitrate, methyl ammonium perchlorate are are exemplary. Other canditates include RDX and HMX, CL-20 and PETN. Inorganic oxidizers include oxidizing ionic species such as nitrates, nitrites, chlorates, perchlorates, peroxides, and superoxides. Typifying these inorganic oxidizers are metal nitrates such as potassium nitrate or strontium nitrate, ammonium nitrate, metal perchlorates such as potassium perchlorate, and metal peroxides such as strontium peroxide. In general, the oxidizer is ordinarily present in an amount effective to ensure oxidation of at least the fuel in the igniter and can be in a range of, for example, of about 40% by weight to about 90% by weight, and more particularly about 70% by weight to about 85% by weight, relative to the dry ingredients in the formulation.

The igniter composition can be formulated with an additional fuel, assuming that the binder may be capable of functioning as a secondary, not primary, fuel for the igniter composition. These additional fuels include powdered metals, such as powdered aluminum, zirconium, magnesium and/or titanium, among others; metal hydrides such as zirconium or titanium hydride; and so-called metalloids, such as silicon and boron which are capable of being sufficiently "dispersable" in the binder. Water-soluble or water-dispersable fuels include, e.g., guanidine nitrate, cyano compounds, nitramines (RDX and/or HMX), CL-20, tetranitrocarbazoles, organic nitro compounds, and may, if desired, be "multi-modal" in particle size distribution. Water dispersable materials can be added in substantially even particle size distribution or in multi-modal distributions depending on the ignition characteristics desired.

Water dispersable fuels are, by present preference, used in fine particulate form, such as powder or ground to sufficient fine particles, to ensure adequate distribution during the manufacturing process. By preference, an at least substantially even distribution in the resultant extrudable igniter composition is desired. In general, the fuel is in pulverulent form, such as 100$\mu$ or less, such as, for example, from about 1$\mu$ to 30$\mu$. Metals in powder form may have, if desired, a smaller particle size range, such as from about 1 to 20$\mu$, or even smaller such as 1 to about 5$\mu$. The amount of fuel—other than the binder—can be in a range of, for example, of about 5 to about 30% by weight, and more particularly about 10% by weight to about 20% by weight, relative to the dry ingredients in the formulation.

The present igniter sticks can incorporate, if desired, a reinforcement. Suitable reinforcement can be achieved with fibers, such as combustible fibers, which serve to both strengthen the extruded igniter stick, and, upon appropriate selection of the reinforcement, can improve ingiter performance. Representative reinforced igniter sticks and the formulations therefor are reported in the Examples.

The present composition in extrudable form is readily obtainable, for instance, by mixing binder, fuel, oxidizer and the selected amount of water for such a period of time to achieve an at least substantially even distribution of the fuel, if used, and oxidizer throughout the binder. One method involves mixing a water-soluble binder and a selected amount of water to form a pre-mix, and admixing the pre-mix with (a) first the fuel and then the oxidizer, or (b) the oxidizer and then the fuel, or (c) a combination of the oxidizer and fuel. The amount of water is generally such that the resultant product has a consistency which is extrudable, but, by preference, is not runny. In principle greater amounts of water can be used but some manufacturing concerns may arise, including an increase in waste water laden with varying amounts of pyrotechnic species (fuel, oxidizer etc.).

The igniter composition thus formed is capable of being extruded to the desired physical geometry.

The igniter sticks can be used in combination with solid propellant rockets or other apparatus which require ignition of solid propellant. Other apparatus includes, without limitation, flares. Among the suitable flares are those known to those skilled in the art as thrusted flares of which the MJU-10 flare is exemplary. Other flares such as M-206 flares (which may or may not be spectrally matched) or a near IR flare, such as a M-278 type flare, are also suitably combined with one or more igniter sticks. The suitable flares are not restricted to the aforementioned MJU-10, M-206 or M-278 flares. For instance, a so-called standard 2.75 inch (cross-section diameter) flare, including visible illuminating flares, are suitably provided with at least one igniter stick. Non-commercial flare variants of the standard flare, such as the M-257 type flare, are also suitably provided with one or more igniter sticks. Advantagesously, the igniter stick decreases the costs, decreases the fabrication time, and simplifies the design of flares, including the ignition system for a thrusted flare such as the MJU-10 flare. Igniter sticks can be used in a great number of decoy devices which include decoy flares which are deployed to defend against an incoming threats, and particularly against heat-seeking missiles. The igniter stick(s) improve the reliability of flare ignition by decreasing out-of-place first fire, and the safety of manufacturing flares by eliminating the use of flammable solvents commonly used when applying traditional first fires. Suitable flares and/or flare compositions for combination with at least one igniter stick are described in Encylopedia of Chemical Technology, 20:680–697 (4th ed, 1996), including the references cited therein, the complete disclosure of which is incorporated herein by reference.

The igniter sticks can be used with larger sized solid propellant launch vehicles, such as solid propellant rockets. In these larger more complex systems, the igniter stick can be used as part of an ignition system, e.g., as a starter in the pyrotechnic train to propagate or initiate propagation of ignition. Solid propellant rockets which can be equipped with at least one igniter stick as at least part of the ignition system include those described in *Solid Rocket Propision Technology* (Pergamon Press, 1st Edition 1993) and *Rocket Propulsion Elements* (Wiley Interscience, 4th Edition 1976), the complete disclosures of which are incorporated by reference. The well-known Jane's Handbook describes flares and other solid propellant devices suitably used in combination with the igniter sticks.

Extrusion and extruders are described generally in Encyclopedia of Polymer Science and Engineering, 16:570–631 (2nd Edition 1996), including references cited therein, the complete disclosures of which are incorporated herein by reference.

FIG. 1 illustrates, in cross-section, a type of flare known as a XM212 flare. In the longitudinal cross section view, the casing is a suitable pressure enclosure fabricated from steel or other material capable of being used for a flare application. The cartridge case 18 can have a vented housing 17. One closed end is defined by the forward closure 19. The opposing end of the XM212 flare includes an aft closure 12, spacers 13, an ignition system with igniter 15, protective cap 10 and a piston 11. In a preferred embodiment, a solidified (extruded) igniter stick 16, which may be solid or hollow, extends lengthwise (completely or partially) through the propellant grain as shown in FIG. 1. The igniter stick can be formed by extruding the hereinabove described extrudable igniter composition, allowing the extrudate to solidify, and inserting it into the propellant grain (preferably before its cured.) A selected propellant composition 14 surrounds the igniter stick. A so-called rapid deflagration cord, if desired, can be disposed lengthwise, e.g., such as loosely sleeved, within a hollow igniter stick. Although not illustrated, more than one igniter stick can, if desired, be used.

Cross-sectional "diameter" views of flare casings with propellant and igniter sticks are shown in FIGS. 2–5. In the diameter cross-sectional view of FIG. 2, the flare case 28 can, if desired, have a foam layer 22 (e.g. a foamed nitrocellulose liner) sprayed on its interior surface before propellant 24 is loaded. A center bore having a pre-selected geometry 26 sleeves a hollow igniter stick 20 (in end view such as quargum binder/B/$KNO_3$).

Figure 3:
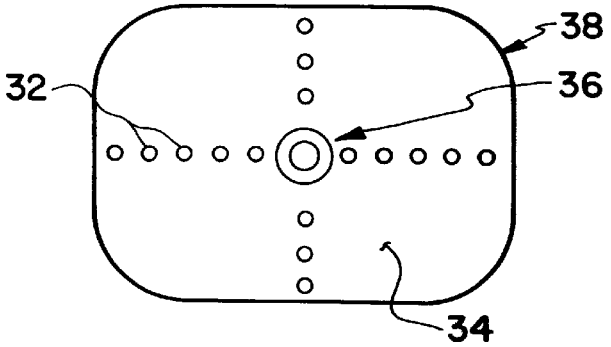

In the diameter cross-sectional view of FIG. 3, the flare case 38 has been loaded with propellant 34 and provided with a centrally positioned hollow igniter stick 36. Optionally, additional solid or hollow igniter sticks 32 can be provided.

Figure 4:
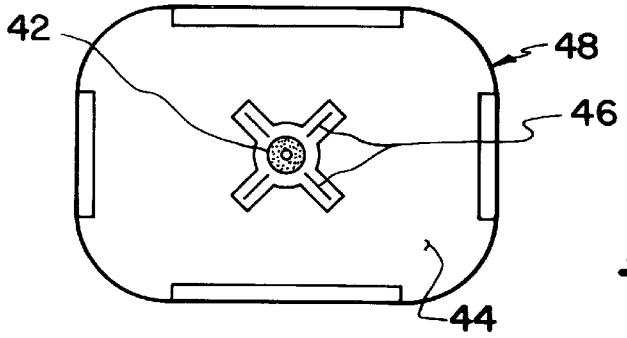

In the diameter cross-sectional view of FIG. 4, flare case 48 is loaded with propellant 44, and a centrally positioned shaped bore of pre-selected geometry. The centrally positioned bore may have an igniter stick 42 with igniter sticks 46 (in strip form) disposed radially in the slots from the bore. The igniter sticks are fitted within the slots, and preferably are not loosly fitted.

Figure 5:
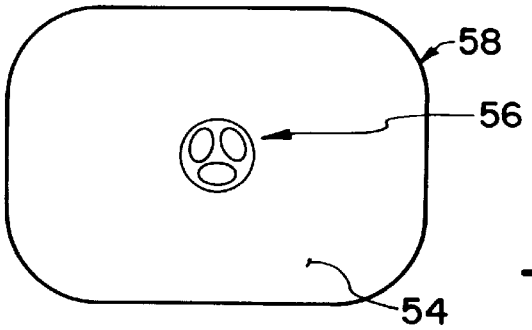

In the diameter cross-sectional view of FIG. 5, the flare case 58 is shown loaded with propellant 54 and a centrally positioned igniter stick having multiple axial bores therein.

The igniter stick can, if desired, be fitted with a peelable glove/sleeve prior to its insertion into the propellant grain. This can protect an igniter stick during the manufacturing process or during storage before use.

The igniter sticks are preferably inserted into the propellant grain before the latter is cured.

Igniter compositions are disclosed in co-pending U.S. complete application Ser. No. 09/119,517, filed Jul. 21, 1998, the complete disclosure of which is incorporated herein by reference.

The invention is further described with reference to the following non-limiting Examples.

EXAMPLES

Example 1

To a one gallon Baker-Perkins planetary mixer, 1170 g (78%) of 35 micron potassium nitrate and 105 g (7%) of Cytec Cyanamer® N-300 brand polyacrylamide (15 million MW) were added. These ingredients were then blended remotely in the dry state for one minute. To this blend, 217.5 g (14.5 parts per 100 of igniter formulation) of water were added and mixed for five minutes. The mix blades and inner surface of the mix bowl were scraped with Velostat (conductive plastic) spatulas followed by 15 additional minutes of mixing. To the resulting thick white paste, 225 g (15%) of amorphous boron powder (90–92% purity) were added and mixed remotely for five minutes. While wearing approved protective clothing, the blades and bowl were again "scraped down" manually and the formulation was mixed for ten additional minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.30". The die included a central 0.080" diameter pin, thus producing a hollow rod-like configuration. The extruded igniter formulation was cut into 7" lengths. Before drying, a 7.5" length of 0.07" diameter. Teledyne RDC (rapidly deflagrating cord) was inserted into the 0.08" diameter perforation. The igniter sticks were dried at 165° F. overnight. The igniter sticks were tested to evaluate their performance as an igniter in an inflator which was designed for passenger side automotive safety bags. The igniter sticks performed satisfactorily.

Example 2

A series of extruded igniter stick formulations containing boron, potassium nitrate, a water-soluble binder, and optionally, fibers for reinforcement were prepared. These formulations are reported in Table I. The formulations were first mixed on a 10 g and then a 30 g scale to determine their sensitivity towards stimuli including impact, friction, electrostatic discharge, and heat (Table II). In general, carbohydrate-based binders exhibited the greatest sensitivity with respect to ABL friction. Formulations containing methyl cellulose, guar gum, and locust bean gum as the binder were also used to prepare igniter sticks.

The remaining formulations were mixed on a 325 g scale in a one pint Baker-Perkins planetary mixer. Potassium nitrate and the respective water-soluble binder were blended remotely in the dry state for one minute. To this blend, the respective amount of water (Table III) was added and the slurry was mixed for five minutes. As in Example 1, the bowl and blades were "scraped down". At this point, fibers were added to fiber-containing formulations and the dough was mixed for an additional 5 minutes. All formulations were mixed for 10 additional minutes before adding boron. One half of the boron was added at this point followed by five minutes of mixing. The rest of the boron was then added followed by an additional five minutes of mixing. After a final "scrape down", the formulation was mixed for an additional ten minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.305". The die included a centrally located 0.80" diameter pin. The extruded igniter formulation was cut into 7" lengths. Before drying, a 7.5" length of 0.07" diameter. Teledyne RDC (rapidly deflagrating cord) was inserted. Ten additional 2" lengths were extruded. The igniter sticks were dried at 165 F. overnight.

Important factors in determining useful formulation include quality of the grain after drying, actual performance as an igniter, and drying rate. Leaching of a mixture of $KNO_3$ and binder to the surface of the grain may occur for some formulations during drying. Leaching in the perforation is not desired. Leaching was found to be least important in formulations containing tragacanth gum, Cyanamer® A-370 and Cyanamer® P-21 (Table III). Igniter sticks from the formulations containing Cyanamer® A-370 and Cyanamer® P-21 were evaluated in content with an inflator device. Relative drying rates of 10:1.7:1 were calculated for formulations containing Cyanamer® N-300, Cyanamer® P-21 and Cyanamer® A-370, respectively. Thus, the formulation containing Cyanamer® A-370 was shown to dry quickly, with minimal $KNO_3$ leaching producing a grain that ignites gas generant with minimal ignition delays.

It is important to develop an extruded igniter stick for flares and other solid propellant devices that will withstand decades of jolts and vibrations while in service prior to deployment. Thus, a durability test method was developed for the extruded igniter sticks. Durability tests were performed in 3-point bending, with the load applied at mid-span. Bending was selected since tensile, compressive, and shear stresses are all present. Also, the sample configuration lends itself to this type of loading. A span of 1.5 inches was used, with the loads applied using ⅛ to ¼-inch diameter dowel pins. A nominal pre-load of 0.7 pounds was applied. The sample was then subjected to 1,000 loading cycles with the following conditions: cyclic amplitude 0.003 inch, frequency 10 Hertz. After the cyclic loading, the samples were tested to failure at a displacement rate of 0.2 inches per minute. The durability of each sample is reported as the area under the load-displacement curve. For simplicity, the units are maintained as calibrated (load in pounds-force, displacement in milli-inches). Therefore, the reported durability has units of milli-inch-pounds. All testing was performed at lab ambient temperature (75°±5° F.). Durability test results indicated enhanced durability of extruded igniter formulations containing fibers, e.g., formulation #13 and #15 in Table III.

TABLE I

Examples of Igniter Formulations Designed for Extrusion with Water.

| Form. # | % KNO3 | % Boron | Binder | % Binder | Fiber | % Fiber |
|---|---|---|---|---|---|---|
| 1 | 78.00 | 15.00 | Cyanamer ® N-300[1] | 7.00 | none | 0.00 |
| 2 | 77.50 | 15.50 | Methyl Cellulose | 7.00 | none | 0.00 |
| 3 | 76.30 | 16.70 | Cyanamer ® A-370 | 7.00 | none | 0.00 |
| 4 | 77.80 | 15.20 | Cyanamer ® P-21 | 7.00 | none | 0.00 |
| 5 | 78.00 | 15.00 | Cyanamer ® N-300 LMW | 7.00 | none | 0.00 |
| 6 | 76.50 | 16.50 | Tragacanth Gum | 7.00 | none | 0.00 |
| 7 | 76.50 | 16.50 | Locust Bean Gum | 7.00 | none | 0.00 |
| 8 | 76.50 | 16.50 | Karaya Gum | 7.00 | none | 0.00 |
| 9 | 78.00 | 15.00 | PAM 10000 MW | 7.00 | none | 0.00 |
| 10 | 76.50 | 16.50 | Guar Gum, FG-1, H.V. | 7.00 | none | 0.00 |
| 11 | 77.00 | 16.00 | Gelatin, Bovine Skin | 7 | none | 0.00 |
| 12 | 78.50 | 12.50 | Cyanamer ® N-300 | 7.00 | C Fiber, | 2.00 |
| 13 | 78.50 | 12.50 | Cyanamer ® N-300 | 7.00 | C Fiber, | 2.00 |
| 14 | 78.50 | 12.50 | Cyanamer ® N-300 | 7.00 | SiC | 2.00 |
| 15 | 75.70 | 14.50 | Cyanamer ® N-300 | 6.80 | Saffil ®, Type | 2.00 |

[1]Cyanamer is a registered trademark of Cytec Industries Inc. for specialty polymers of polyacrylamide, sodium polyacrylate or copolymers thereof.

TABLE II

Safety Characteristics of Extruded Igniter Formulations

| Form. | Binder | Fiber | ABL | ABL Sliding |
|---|---|---|---|---|
| 1 | Cyanamer ® N-300 | none | 80 GL | 800 @ 8 ft/s GL |
| 2 | Methyl Cellulose | none | 6.9 GL | 240 @ 6 ft/s YL |
| 3 | Cyanamer ® A-370 | none | 21 GL | 800 @ 8 ft/s GL |
| 4 | Cyanamer ® P-21 | none | 21 GL | 800 @ 8 ft/s GL |
| 6 | Tragacanth Gum | none | 21 GL | 320 @ 8 ft/s GL |
| 7 | Locust Bean Gum | none | 13 GL | 180 @ 6 ft/s YL |
| 8 | Karaya Gum | none | 21 GL | 240 @ 8 ft/s GL |
| 9 | PAM 10000 MW | none | 41 GL | 800 @ 8 ft/s GL |
| 10 | Guar Gum, FG-1 | none | 11 GL | 100 @ 6 ft/s YL |
| 11 | Gelatin, Bovine | none | 33 GL | 800 @ 8 ft/s GL |
| 12 | Cyanamer ® N-300 | C Fiber, Fortafil ® F5C | 33 GL | 800 @ 8 ft/s GL |
| 13 | Cyanamer ® N-300 | C Fiber, Pyrograph ™ III | 41 GL | 800 @ 8 ft/s GL |
| 14 | Cyanamer ® N-300 | SiC Whiskers, Silar ® | 41 GL | 800 @ 8 ft/s GL |
| 15 | Cyanamer ® N-300 | Saffil ®, Type 590 | 51 GL | 420 @ 8 ft/s GL |

[1]Units are in centimeters.
[2]Units are in pounds.

TABLE III

Test Result Summary for Extruded Igniters

| Form. | Binder ID | Additive ID | Water[1] | Durability[2] | % Perf Blockage[3] |
|---|---|---|---|---|---|
| 1 | Cyanamer ® N-300 | none | 14.5 | 55 | 100 |
| 3 | Cyanamer ® A-370 | none | 12.5 | 40 | 9 |
| 4 | Cyanamer ® P-21 | none | 11.5 | 34 | 45 |
| 5 | Cyanamer ® N-300 LMW | none | 14.5 | 69 | 100 |
| 6 | Tragacanth Gum | none | 19 | 32 | 33 |
| 8 | Karaya Gum | none | 14.5 | 25 | 100 |
| 9 | PAM 10000 MW[4] | none | 14 | NA | NA |
| 11 | Gelatin, Bovine Skin | none | 10.5 | 44 | 100 |
| 12 | Cyanamer ® N-300 | C Fiber, | 16.5 | 69 | 100 |
| 13 | Cyanamer ® N-300 | C Fiber, | 16.5 | 97 | 83 |
| 14 | Cyanamer ® N-300 | SiC Whiskers, | 17.5 | 51 | 100 |
| 15 | Cyanamer ® N-300 | Saffil ®, Type | 15.5 | 94 | 100 |

[1]The parts per 100 of water added to the formulation necessary to allow efficient single-screw extrusion.
[2]Units are in milli-inch-pounds.
[3]The percentage of blocked perforations was determined from six or more 0.33" OD, 0.08" ID, 2" L igniter sticks.
[4]Formulation No. 9 did not extrude very well.

Example 3

A series of igniters containing fibers were formulated with the goal of enhancing durability of the extruded igniter sticks as seen from Table IV. All formulations exhibited favorable safety characteristics. Samples (325 g) of each formulation were mixed in a Baker-Perkins pint mixer with 13.5 parts/100 of water. After dry blending the $KNO_3$ and Cyanamer® A-370 for one minute, the water was added followed by five minutes of mixing. The fiber was then added in two increments and the boron in three increments with three minutes of mixing after each addition. After a final "scrape down", the formulation was mixed for an additional ten minutes. The resulting brown, dough-like material was granulated to −4 mesh and fed into a Haake 25 mm single-screw extruder. The igniter formulation was extruded through a 12 point star die with a maximum diameter of 0.33" and a minimum diameter of 0.305". The die included a centrally located 0.15" diameter pin. The extruded igniter formulation was cut into 7" lengths. Ten additional 2" lengths were extruded. The igniter sticks were dried at 165 F. overnight.

There were no signs of $KNO_3$/binder leaching outside of the igniter grains after drying. Grains were ignited with the ignition plume of an ES013 squib directed into the 0.15" ID perforation in the grain. The igniter grain was held in a 0.4" ID, 0.49" wall, cylindrical fixture with approximately 95 evenly distributed 0.109" ID holes drilled along its length and diameter. The times required for the flame front to reach the opposite end of the grain after ignition by the squib are reported in Table V. The times were determined from 1000 frames/second video. Generally, only a few milliseconds were required. Durability of 2" long grains was determined as described in Example 2. The results are reported in Table V. By far, the formulation containing 2% polyethylene fibers exhibited the greatest durability. Firings were conducted using igniter grains from formulations #3 and #19 with RDC inserted into the 0.15" perforation. Formulation #19 with polyethylene fibers produced the least amount of delay before the pyrotechnic composition was ignited.

TABLE IV

Igniter Formulations containing Cyanamer ® A-370 and Selected Fibers.

| Form | % KNO3 | % Boron | % Cyanamer ® A-370 | Fiber ID | % Fiber |
|---|---|---|---|---|---|
| 3 | 76.30 | 16.70 | 7.00 | none | 0.00 |
| 16 | 76.70 | 14.30 | 7.00 | Pyrograph ™ III, Micro | 2.00 |
| 17 | 74.80 | 16.20 | 7.00 | Saffil ®, Type 590, Micro | 2.00 |
| 18 | 74.80 | 16.20 | 7.00 | Nextel ®, ⅛" Ceramic | 2.00 |
| 19 | 77.20 | 13.80 | 7.00 | Allied, Spectra 900, ⅛" | 2.00 |
| 20 | 76.50 | 14.50 | 7.00 | Celanese, ⅛" PBI | 2.00 |

TABLE V

Test Result Summary for Potential Extruded Igniters Containing Fibers.

| Form | Fiber ID | Ignition | Ignition | Durability[3] | Coefficien |
|---|---|---|---|---|---|
| 3 | none | 2 | 2 | 96 | 39 |
| 3[1] | none, 0.125" ID | 9 | 8 | 101 | 25 |
| 16 | Pyrograph ™ III, Micro | 5 | | 65 | 39 |
| 17 | Saffil ®, Type 590, Micro | 1 | | 107 | 4 |
| 18 | Nextel ®, ⅛" Ceramic | 3 | | 76 | 69 |

TABLE V-continued

Test Result Summary for Potential Extruded Igniters Containing Fibers.

| Form | Fiber ID | Ignition | Ignition | Durability[3] | Coefficien |
|---|---|---|---|---|---|
| 19 | Allied, Spectra 900, ⅛" | 17 | 1 | 357 | 17 |
| 20 | Celanese, ⅛" PBI | 13 | | 126 | 22 |

[1]Formulation 3 with grains having a 0.125" ID instead of the nominal 0.15" ID.
[2]Time required for the flame front on a 7" grain ignited on one end to reach the opposite end. The time is in milliseconds. The data were acquired as described in Example 3.
[3]The same as in footnote 1 but cured epoxy blocking the .15" ID perforation at the opposite end from where ignition was intiated.
[4]Units are in milli-inch-pounds.

In formulations 16, 17, 18, 19 and 20, respectively, the "fiber ID" can be characterized as carbon fiber, alumina fiber, aluminosilicate, polyethylene, and polybenzimidizole.

Example 4

An extrudable igniter composition was obtained by forming a pre-mix of guar gum (5.0 wt %, 0.25 gram) and water (deionized 15.0 wt %, 1.75 grams); combining the pre-mix with potassium nitrate (average particle size of about 26 microns, 75 wt %, 3.75 grams); and adding thereto fuel, boron (amorphous; 20.0 wt %, 1.00 gram).

Example 5

An extrudable igniter composition was obtained as in Example 4, but 20.0 wt % of water was used.

Example 6

An extrudable igniter composition was prepared as in Example 4, except that the amount of fuel, boron, was increased to 22.0 wt % (1.10 grams) and the amount of binder, guar gum, was reduced to 3.0 wt % (0.15 gram).

Example 7

An extrudable igniter composition was prepared according to the procedure of Example 4, except that the binder was polyacrylamide (cyanamer "N-300" from American Cyanamid, 5.0 wt %, 0.25 gram).

Example 8

An extrudable igniter mixture is prepared by adding potassium nitrate (210 grams) and a polyacrylamide (14 gram; cyanamer "N-300" from American Cyanamid) to a bowl; adding water (44.8 grams), to the bowl and mixing for 1 minute; and adding boron (amorphous; 56.0 grams) thereto followed by mixing for about four minutes.

Example 9

An extrudable igniter composition was prepared as in Example 8, except that the amount of water is 50.4 grams, the potassium nitrate and binder are first dry-blended together before adding the water and mixing 1 minute. The powdered boron is then added and the mixing is continued for four minutes.

Example 10

The igniter composition prepared according to Example 8 was granulated, dried and pressed into ½ inch diameter by 1 inch long pellets. The pellets were then inhibited on all but one face and combusted in a closed pressurized vessel at 1000, 2000 and 3000 psi via ignition of the uninhibited face. Burning rates of 4.16 ips, 4.32 ips and 4.42 ips respectively, were observed.

Example 11

A portion of the wet igniter composition prepared as described in Example 9 was placed in a 2 in diameter ram extruder and forced through an appropriate die so as to provide a center perforated cylindrical extrudate of approx 0.3 in diameter with a perforation diameter of approx 0.06 in. This extrudate was partially dried and cut into 7 in lengths prior to final drying. The resulting igniter sticks were then tested in a gas generating device consisting of a tubular metal cylinder approx 8 in long by approx 2 in diameter closed at both ends and provided with radial ports. One of the end closures was further provided with an initiating squib. The igniter stick was retained in the center of the tube and a 7 in length of rapid deflagration cord (RDC) placed in the center perforation of the stick. The gas generating device was then filled with a charge of gas generant pellets and tested in a closed tank. Comparable results were obtained with the igniter stick in contrast to those obtained with a conventional ignition train in which a perforated metal tube filled with a like quantity of ignition powder and the RDC replaces the igniter stick/RDC combination. In all cases ignition of the gas generant pellets was observed to occur within 8 msec.

Example 12

Two fifty gram mixes formulated from 20 percent boron, 75 percent potassium nitrate, 5 percent Cytec Cyanamer® ( N-300 brand polyacrylamide (15 million molecular weight), and 17.5 weight percent of water were produced. The mixes were combined and then loaded into a 2.0 inch diameter RAM extruder. The RAM was pressurized to 300 psi to extrude the igniter sticks. The igniter composition was originally extruded into 0.100 inch diameter solid sticks and also into 0.100 inch diameter with a 0.030 inch diameter center perforation. The igniter sticks were cut into 6 inch lengths and dried at 135° F. overnight prior to use. The center perforated igniter sticks were successfully demonstrated in an XM-212 decoy flare. Two XM 212 grains were fabricated. One with the traditional slurry first fire and the other with three center perforated igniter sticks. A flare configuration with an igniter stick is shown in FIG. 1.

Example 13

The igniter sticks were also incorporated in the main ignition system of a MJU-10 decoy flare. The MJU-10 flare requires a larger igniter than the XM-212 flare. Therefore, the igniter formulation was extruded through a 12 point star die that has a 0.33 inch maximum diameter a 0.30 inch minimum diameter. The extrusion die also included a 0.80 inch diameter pin used to produce a center perforated grain. The extruded igniter sticks were cut to 5.0 inch lengths and then dried at 135° F. for 24 hours. The igniter sticks were then inserted into the center perforation of the MJU-10 flare grain. The MJU-10 flare was successfully ignited with the igniter stick.

In view of the foregoing, the igniter stick will decrease the cost, decrease the fabrication time, and simplify the design of an ignition system for the thrusted MJU-10 flare.

In view of the Examples, igniter sticks can be used in a great number of decoy flare devices. They will aid in improving the reliability of flare ignition by decreasing out-of-place first fire, and also improve the safety of manufacturing flares by eliminating the use of flammable solvents commonly used when applying traditional first fires.

What we claim is:

1. A flare comprising a case, propellant contained within said case, and an igniter system comprising an extruded dry igniter element for igniting said propellant of said flare, said extruded dry igniter element deflagrating upon ignition and being formed from an extrudable igniter composition comprising, as ingredients prior to drying to form said dry igniter element, at least one water-soluble binder dissolved into an aqueous solution, at least one oxidizing agent, at least one fuel, and, optionally, fibers, wherein said water-soluble binder comprises at least one member selected from the group consisting of a water-soluble polymeric binder, a water-soluble gum present in an amount of from about 2% by weight to about 10% by weight based on the total amount of dry ingredient in said extrudable igniter composition, and water-soluble gelatin, and wherein formation of said extruded dry igniter element comprises drying the extrudable igniter composition of water.

2. The flare of claim 1, wherein said water-soluble binder comprises at least one member selected from the group consisting of poly-N-vinyl pyrolidone, polyvinylalcohol, copolymers of poly-N-vinyl pyrolidone and polyvinylalcohol, polyacrylamide, sodium polyacrylates, and copolymers of polyacrylamide and polyacrylates.

3. The flare of claim 2, wherein said water-soluble binder comprises poly-N-vinyl pyrolidone.

4. The flare of claim 2, wherein said water-soluble binder comprises polyvinylalcohol.

5. The flare of claim 2, wherein said water-soluble binder comprises gum.

6. The flare of claim 2, wherein said water-soluble binder comprises polyacrylamide.

7. The flare of claim 1, wherein said oxidizer is present in an amount of from about 40% by weight to about 90% by weight relative to the dry ingredients used in formulating said extrudable igniter composition.

8. The flare of claim 1, wherein said oxidizer comprises an organic oxidizer.

9. The flare of claim 1, wherein said oxidizer comprises at least one ionic species selected from the group consisting of nitrate, nitrite, chlorate, perchlorate, peroxides, and superperoxides.

10. The flare of claim 1, wherein said extrudable igniter composition contains fibers.

11. The flare of claim 10, wherein said fibers comprise at least one of polyolefin fibers, polyamide fibers, polyester fibers, or poly(2,2'-(m-phenylene)-5,5-bisbenzimidazole fibers.

12. The flare of claim 1, wherein (a) said binder comprises at least one member selected from the group consisting of poly-N-vinyl pyrolidone, polyvinylalcohol, copolymers of poly-N-vinyl pyrolidone and polyvinylalcohol, sodium polyacrylates, and gum; (b) said oxidizer is present in an amount of from about 40% by weight to about 90% by weight relative to the dry ingredients used in formulating said extrudable igniter composition, and said oxidizer contains at least one ionic species selected from the group consisting of nitrate, nitrite, chlorate, perchlorate, peroxides, and superperoxides; (c) said extrudable igniter composition contains low-aspect ratio fibers, said fibers comprising at least one of polyolefin fibers, polyamide fibers, polyester fibers, and poly(2,2'-(m-phenylene)-5,5-bisbenzimidazole fibers.

13. The flare of claim 1, wherein said extruded igniter element is in the form of an igniter stick.

14. The flare of claim 1, wherein said fuel comprises boron and said oxidizer comprises potassium nitrate.

15. The flare of claim 14, wherein said water-soluble polymeric binder comprises a polymer or copolymer comprising at least member selected from the group consisting of polyacrylamide, sodium polyacrylates, and copolymers thereof.

16. The flare of claim 15, wherein said boron is present in an amount of about 5% to about 30% by weight, said potassium nitrate is present in an amount of about 40% to about 90% by weight, and the binder is present in an amount of about 2% to about 10% by weight.

17. The flare of claim 16, wherein said extruded igniter element further comprises, as an additional ingredient, guanidine nitrate.

18. A method of forming a flare comprising a case, propellant contained within the case, and an igniter system comprising an extruded dry igniter element deflagrating upon ignition for igniting the propellant of said flare, the extruded dry igniter element being formed from an extrudable igniter composition, said method comprising:

dissolving at least one water-soluble binder into an aqueous solvent, mixing the dissolved binder with at least one oxidizing agent, at least one fuel, and, optionally, fibers to form the extrudable igniter composition, and extruding and drying the extrudable igniter composition, wherein the water-soluble binder comprises at least one member selected from the group consisting of a water-soluble polymeric binder, a water-soluble gum present in an amount of from about 2% by weight to about 10% by weight based on the total amount of dry ingredient in the extrudable igniter composition, and water-soluble gelatin.

19. The method of claim 18, wherein the water-soluble binder comprises at least one member selected from the group consisting of poly-N-vinyl pyrolidone, polyvinylalcohol, copolymers of poly-N-vinyl pyrolidone and polyvinylalcohol, polyacrylamide, sodium polyacrylates, and copolymers of polyacrylamides and sodium polyacrylates.

20. The method of claim 19, wherein the water-soluble binder comprises poly-N-vinyl pyrolidone.

21. The method of claim 19, wherein the water-soluble binder comprises polyvinylalcohol.

22. The method of claim 19, wherein the water-soluble binder comprises gum.

23. The method of claim 19, wherein the water-soluble binder comprises polyacrylamide.

24. The method of claim 18, wherein the oxidizer is present in an amount of from about 40% by weight to about 90% by weight relative to the dry ingredients used in formulating the extrudable igniter composition.

25. The method of claim 18, wherein said oxidizer comprises an organic oxidizer.

26. The method of claim 18, wherein the oxidizer comprises at least one ionic species selected from the group consisting of nitrate, nitrite, chlorate, perchlorate, peroxides, and superperoxides.

27. The method of claim 18, wherein the extrudable igniter composition contains fibers.

28. The method of claim 27, wherein the fibers comprise at least one of polyolefin fibers, polyamide fibers, polyester fibers, or poly(2,2'-(m-phenylene)-5,5-bisbenzimidazole fibers.

29. The method of claim 28, wherein (a) the binder comprises at least one member selected from the group consisting of poly-N-vinyl pyrolidone, polyvinyl alcohol, copolymers of poly-N-vinyl pyrolidone and polyvinylalcohol, sodium polyacrylates, and gum; (b) the oxidizer is present in an amount of from about 40% by weight to about 90% by weight relative to the dry ingredients used in formulating the extrudable igniter composition, and the oxidizer contains at least one ionic species selected from the group consisting of nitrate, nitrite, chlorate, perchlorate, peroxides, and superperoxides; (c) the extrudable igniter composition contains low-aspect ratio fibers, the fibers comprising at least one of polyolefin fibers, polyamide fibers, polyester fibers, and poly(2,2'-(m-phenylene)-5,5-bisbenzimidazole fibers.

30. The method of claim 18, wherein the extruded igniter element is in the form of an igniter stick.

* * * * *